US010905626B2

(12) United States Patent
Bradbury Goulsby

(10) Patent No.: US 10,905,626 B2
(45) Date of Patent: Feb. 2, 2021

(54) ANKLE-MOUNTED SEXUAL STIMULATION DEVICE AND METHOD OF USE

(71) Applicant: Malia Lynn Pua Olena Bradbury Goulsby, Torrance, CA (US)

(72) Inventor: Malia Lynn Pua Olena Bradbury Goulsby, Torrance, CA (US)

( * ) Notice: Subject to any disclaimer, the term of this patent is extended or adjusted under 35 U.S.C. 154(b) by 91 days.

(21) Appl. No.: 16/012,404

(22) Filed: Jun. 19, 2018

(65) Prior Publication Data

US 2019/0110948 A1 Apr. 18, 2019

Related U.S. Application Data

(60) Provisional application No. 62/573,003, filed on Oct. 16, 2017.

(51) Int. Cl.
*A61H 19/00* (2006.01)
*A61H 1/00* (2006.01)

(52) U.S. Cl.
CPC ..... *A61H 19/44* (2013.01); *A61H 1/00* (2013.01); *A61H 19/32* (2013.01); *A61H 2201/1642* (2013.01); *A61H 2205/106* (2013.01)

(58) Field of Classification Search
CPC ..... A61H 19/44; A61H 19/50; A61H 21/00; A61H 2201/1261; A61H 2201/1642; A61H 2205/086; A61H 1/00; A61H 19/32; A61H 2205/106; A61H 19/40; A61H 2205/087; A61H 2201/1657; A61H 2201/1635; A61H 2201/0192; A61H 1/0266; A61H 1/024; A61H 1/0244; A61H 1/0237
USPC ..... 600/38–41
See application file for complete search history.

(56) References Cited

U.S. PATENT DOCUMENTS 5,038,799 A * 8/1991 Fowler ..... A61F 5/3761 128/878
6,179,795 B1 * 1/2001 Garza ..... A61H 19/44 600/38
6,203,491 B1 * 3/2001 Uribe ..... A61H 19/44 600/38
6,254,561 B1 * 7/2001 Borden ..... A61N 5/1049 128/845
6,899,671 B1 * 5/2005 Fontenot ..... A61H 19/44 600/38
6,991,599 B2 * 1/2006 Hudson ..... A61H 19/44 600/38
7,513,868 B1 * 4/2009 Fontenot ..... A61H 19/44 600/38

(Continued)

*Primary Examiner* — Kaylee R Wilson

(57) ABSTRACT

An ankle-mounted sexual stimulation device and method of use enhances human sexual pleasure. The device includes a bar having a center region and a pair of terminal regions. A pair of ankle cuffs attach to the terminal regions in a freely rotating, swiveling relationship. A strap extends between the terminal regions of bar. A plate slides across length of the bar, and carries a protruding member. A pin passes through apertures in the bar and plate to fixedly fasten the protruding member at the bar. The ankle cuffs detachably attach to the ankles. A leg force applied to the ankle cuffs manipulates the bar and the protruding member in axial, rotational, and lateral directions relative to the vagina or anus. The hands grip the strap and apply a hand force to manipulate the bar and attached protruding member in axial, rotational, and lateral directions relative to the vagina or anus.

20 Claims, 6 Drawing Sheets

(56) References Cited

U.S. PATENT DOCUMENTS

| | | | | |
|---|---|---|---|---|
| 8,313,424 | B2 * | 11/2012 | Gabrielidis | A61H 19/44 600/38 |
| 8,876,695 | B2 * | 11/2014 | Wilson | A61H 19/44 600/38 |
| 2012/0323068 | A1 * | 12/2012 | Atchinson | A61H 19/44 600/38 |

* cited by examiner

ANKLE-MOUNTED SEXUAL STIMULATION DEVICE AND METHOD OF USE

CROSS REFERENCE OF RELATED APPLICATIONS

This application claims the benefits of U.S. provisional application No. 62/573,003, filed Oct. 16, 2017 and entitled BRACKET SYSTEM, which provisional application is incorporated by reference herein in its entirety.

FIELD OF THE INVENTION

The present invention relates generally to an ankle-mounted sexual stimulation device and method of use. More so, the present invention relates to a sexual stimulation device that enhances human sexual pleasure, comprising: a bar that terminates at a pair of attached ankle cuffs, a strap extending between the terminal regions of the bar, and a plate carrying a protruding member along the length of the bar; whereby the ankle cuffs detachably attach to the ankles, so as to enable the legs to manipulate the protruding member in a generally axial direction relative to the vagina or anus for sexual stimulation to the genital between the legs, and the hands grip the strap to manipulate the protruding member in a generally axial and lateral direction relative to the vagina or anus for sexual stimulation to the genital between the legs.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, dildos are generally made of silicone rubber, but can be made of other materials such as body safe metals such as titanium, stainless steel, aluminum, or glass. Dildos are often made to resemble a penis, although some are C-shaped or S-shaped for G-spot or P-spot stimulation.

Many women have tried to masturbate and failed because of the same reason that one cannot tickle oneself This leaves a woman without a partner frustrated and can cause her to seek satisfaction that is not safe, disease free, non impregnating, or is immoral. Married women and single women who are attached to an impotent man are motivated to become unfaithful. Women may need to avoid traditional sexual intercourse because one half of the couple has an infectious disease. With A.I.D.S. (Acquired Immune Deficiency Syndrome) and numerous other sexually transmitted venereal diseases so prevalent in today's society, there are considerable risks involved in extramarital sex. Many women lose their partner to impotency or death while the woman still has sexual needs.

Other proposals have involved sex toys that manipulate a dildo. The problem with these sex toys is that they do not attach to a user, or magnify the force, torque, motions, and repetition to the vagina and anus regions. Also, the leverage and power provided by the legs is not harnessed for powerful thrusting motions by the dildo. Even though the above cited sex toys meet some of the needs of the market, an ankle-mounted sexual stimulation device that enables a protruding member, such as an artificial erect penis, to engage the vagina and the anus with multiple positional combinations having greater torque, resistance, or rate of repetition than prior art sex toys; whereby the legs, ankles, arms, and hands of a single user control the motion of the protruding member, is still desired.

SUMMARY

Illustrative embodiments of the disclosure are generally directed to an ankle-mounted sexual stimulation device and method of use. The ankle-mounted sexual stimulation device serves to enhance human sexual pleasure by attaching to the ankles and allowing the legs and hands to manipulate a protruding member, such as an artificial erect penis, across the vagina or anus.

In some embodiments, the sexual stimulation device may include a bar defined by a center region forming spaced-apart bar apertures, and a pair terminal regions. A pair of ankle cuffs attach to the terminal regions of the bar at a coupling mechanism, forming a free swiveling relationship with the terminal regions of the bar. A strap extends between the terminal regions of the bar, attaching to the coupling mechanism. The strap also forms a free swiveling relationship with the terminal regions of the bar. The strap can be grasped to enable control of the terminal regions s of the bar.

In some embodiments, the sexual stimulation device may include a plate defined by a plurality of spaced-apart plate apertures. The plate is configured to slide along the length of the bar. The plate carries a protruding member along the length of the bar. The protruding member fixedly positions at a desired location along the bar by aligning the bar apertures with the plate apertures and passing a pin through the apertures.

In some embodiments, the ankle cuffs detachably attach to the ankles. In this configuration the legs can move freely to manipulate the bar and the protruding member in a generally axial direction relative to the vagina or anus for sexual stimulation. The hands can also grip the strap, so as to manipulate the bar and protruding member in a generally axial and lateral direction relative to the vagina or anus for sexual stimulation.

One aspect of the present invention is that the bar has a cylindrical shape.

Another aspect is that the bar comprises a center region.

Another aspect is that the center region is a 14" long tube.

Yet another aspect is that the center region has a larger diameter than the terminal regions of the bar.

Yet another aspect is that the center region has a telescoping, length adjustable relationship with the terminal regions of the bar.

Yet another aspect is that the bar is about 40" long.

Yet another aspect is that the plate comprises a bracket.

Yet another aspect is that the bracket is configured to detachably mount the bar.

Yet another aspect is that the ankle cuffs comprise an ankle fastening strap.

Yet another aspect is that the ankle cuffs are 7" long.

Yet another aspect is that the ankle cuffs comprise a second ring.

Yet another aspect is that the coupling mechanism comprises a first ring that attaches to the second ring in a swiveling relationship.

Yet another aspect is that the strap is about 40" long and 1" wide.

Yet another aspect is that the strap is fabricated from vinyl.

Yet another aspect is that the sexual stimulation device further comprises a pin that passes through the bar apertures and the plate apertures.

Yet another aspect is that the protruding member is an artificial erect penis.

One objective of the present invention is to provide a user with sexual gratification and possibly an orgasm.

Another objective is to enable the legs and hands to manipulate a protruding member across the vagina or anus.

Another objective is to leverage the power provided by the legs for powerful thrusting motions into the vagina or anus by the protruding member.

Another objective is to enable the strap to be pulled to adjust the direction of force, torque, and position of the protruding member in relation to the vagina or anus.

Another objective is to provide a protruding member that can be adjusted at multiple positions across the length of the bar.

Another objective is to provide orgasm therapy or orgasm training, so as to address the fact that many women must learn to be orgasmic through experience and practice.

Yet another objective is to be used before sex as a form of foreplay or after sex to achieve orgasm if the sex act did not achieve orgasm.

Yet another objective is to help impotent men achieve an erection for traditional sex by providing the male partner with visual and tactile stimuli from the rider of the sexual stimulation device.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which:

FIG. 2A shows the center region joined with the terminal regions of the bar, and FIG. 2B shows the terminal regions separated from the center region of the bar, in accordance with an embodiment of the present invention;

FIG. 3A shows the a first terminal regions of the bar, and FIG. 3B shows a second terminal region of the bar, in accordance with an embodiment of the present invention;

FIG. 6A shows a link between the rings, and FIG. 6B shows the rings coupled directly, in accordance with an embodiment of the present invention;

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

An ankle-mounted sexual stimulation device 100 and method 200 of use is referenced in FIGS. 1-8. The ankle-mounted sexual stimulation device 100, hereafter "device 100" enables a protruding member 116, such as an artificial erect penis, to engage the vagina and the anus with multiple positional combinations having greater torque, resistance, or rate of repetition than prior art sex toys. In operation, the legs, ankles, arms, and hands of a single user control the motion of the protruding member 116. In this manner, human sexual pleasure can be achieved alone and with greater gratification. However, the users of the device 100 may also include: a woman alone; a woman with a male partner; a woman with a female partner; a man alone; or a man with a male partner.

Figure 1:
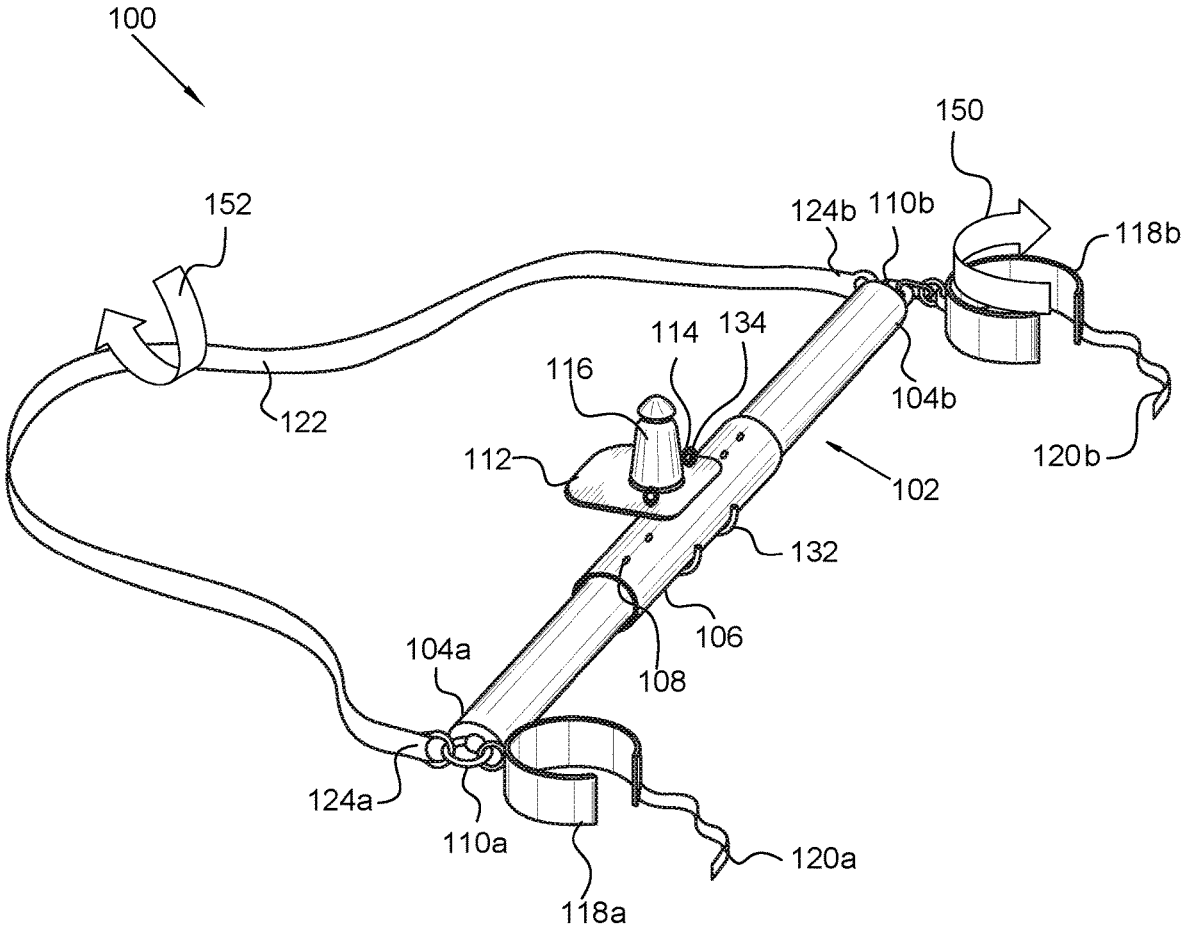
FIG. 1 illustrates a front perspective view of an exemplary an ankle-mounted sexual stimulation device, in accordance with an embodiment of the present invention.

As referenced in FIG. 1, the sexual stimulation device 100 includes a bar 102 that extends longitudinally. The bar 102 is defined by a center region 106 forming spaced-apart bar apertures 108, and a pair terminal regions 104*a*, 104*b*. In one embodiment, the bar 102 has a cylindrical shape and is 40" long. Though in other embodiments, the bar 102 may have different dimensions. In one embodiment, the center region 106 of the bar 102 is a 14" long tube.

Figure 2A:
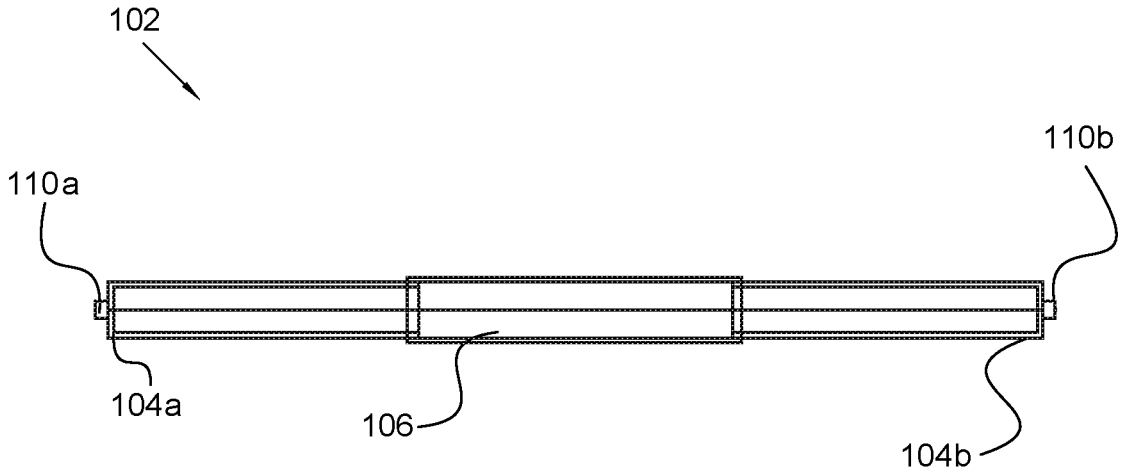
FIGS. 2A and 2B illustrate elevated side views of an exemplary bar, where
Figure 2B:
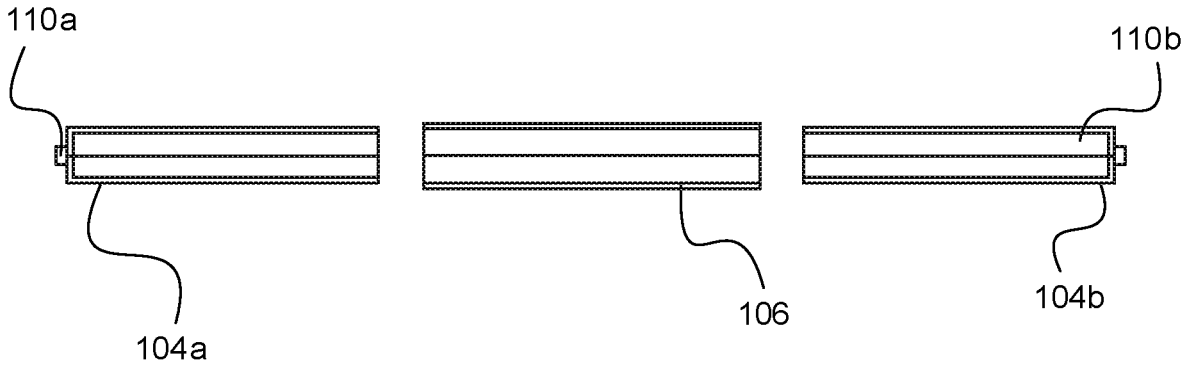
Figure 3A:
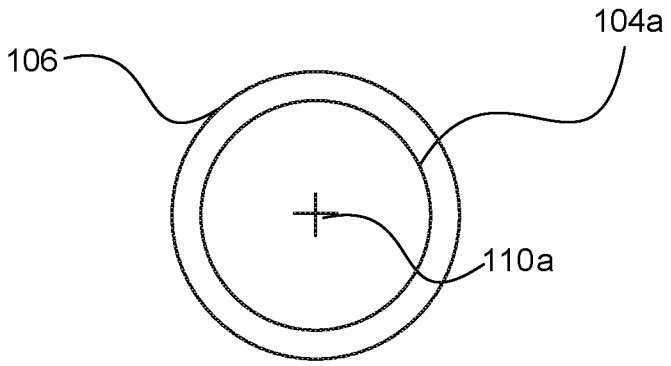
FIGS. 3A and 3B illustrate elevated side views of an exemplary bar, where
Figure 3B:
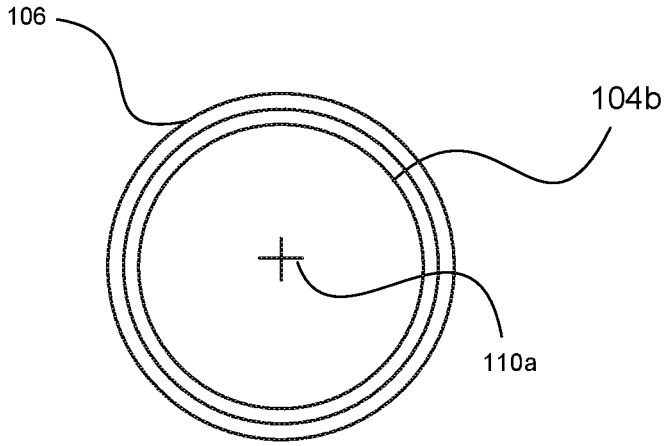

As FIG. 2A illustrates, the center region 106 has a telescoping, length adjustable relationship with the terminal regions 104*a*-*b* of the bar 102. Thus, various length adjustments may be possible with the bar 102 (FIG. 2B). Looking at FIGS. 3A and 3B, it is apparent that the center region 106 of the bar 102 also has a larger diameter than the terminal regions 104*a*, 104*b*. Further, the bar 102 is sufficiently rigid to withstand rigorous motion by the legs and hands, as described below. Suitable materials for the bar 102 may include, without limitation, aluminum, a rigid polymer, a metal alloy, fiberglass, and wood.

Figure 4:
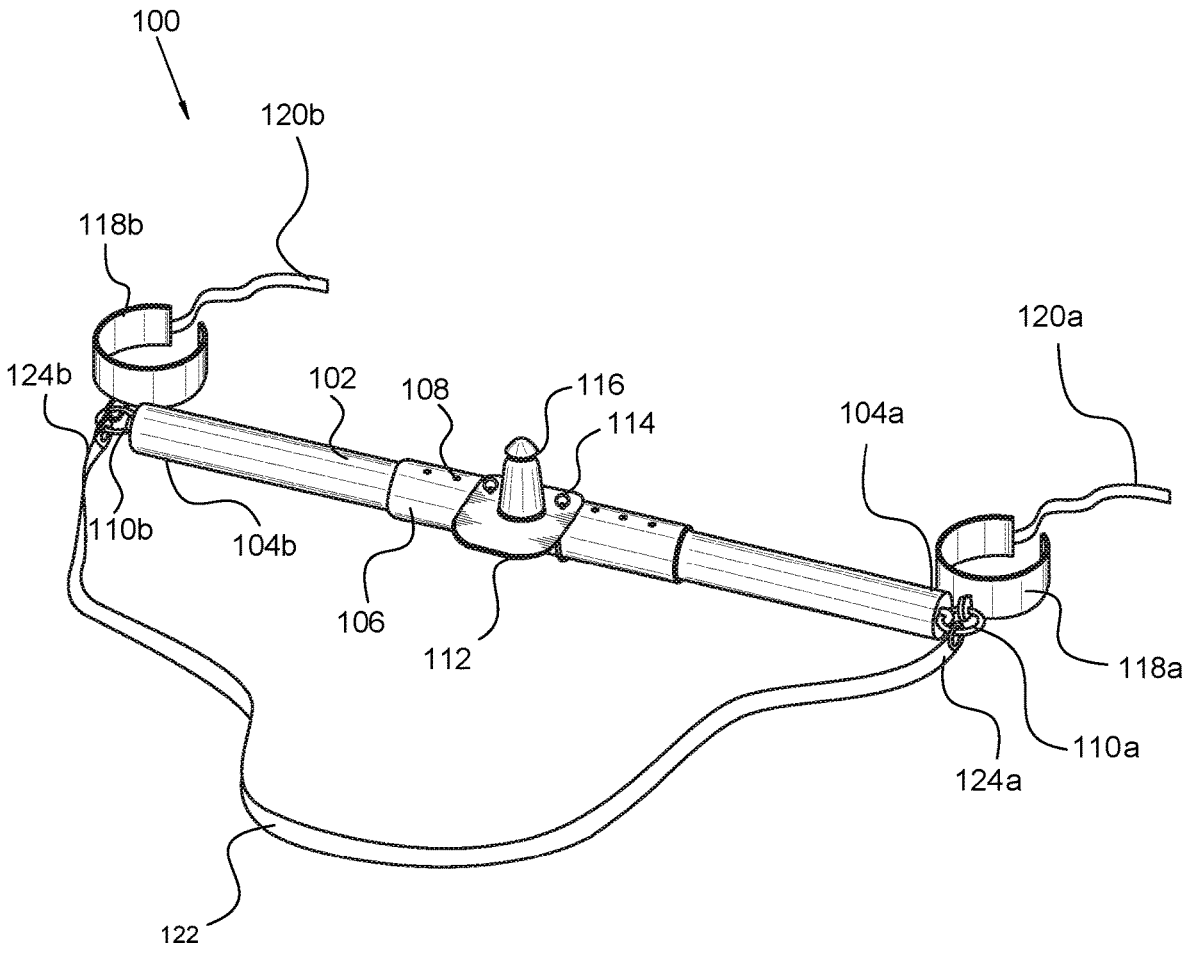
FIG. 4 illustrates a rear perspective view of the ankle-mounted sexual stimulation device shown in FIG. 1, in accordance with an embodiment of the present invention.

Looking now at FIG. 4, the sexual stimulation device 100 may also include a plate 112 that is configured to slide along the length of the bar 102. The plate 112 is defined by a plurality of spaced-apart plate apertures 134 used, along with a pin 114, for fixed positioning along the bar 102. The plate 112 may include a bracket 132 that is configured to detachably mount the bar 102. The bracket 132 may be a U-shaped rigid component that receives the center region 106 of the bar 102, forming a snap-fit relationship. The bracket 132 thus, enables detachable attachment of the plate 112 to the bar 102.

The plate 112 carries a protruding member 116 along the length of the bar 102. The protruding member 116 is sufficiently rigid and elongated to at least partially penetrate the vagina or anus; and thereby provide sexual stimulation thereto. The protruding member 116 is configured to create stimulation in the vagina or anus through various stimulating motions therein, i.e, rotational, thrusting, vibrational, lateral. In some embodiments, the protruding member 116 may include, without limitation, an artificial erect penis, a dildo, a rubber dildo, a glass dildo, a vibrating dildo.

It is also significant to note that a dildo can also exhibit fetishistic value, and may be used in other ways, such as touching one's own or another's skin in various places, often during foreplay or as an act of dominance and submission. In one alternative embodiment, the protruding member 116 is a vibrating dildo that is commercially obtained and can be of various shapes, girths, lengths and textures. The vibrating dildo may include a remote battery pack attached to the bar 102, or be attached to an outside power source with an electrical cord.

In some embodiments, the protruding member 116 fixedly positions at a desired location along the bar 102 by aligning the bar apertures 108 with the plate apertures 134, and then inserting a pin 114 through an aligning pair of apertures. This allows the protruding member 116 to be positioned at various longitudinal points along the length of the bar 102. In this manner, the protruding member 116 can be adjusted across the bar 102 to accommodate differently sized users, and different sexual stimulation activities.

Figure 5:
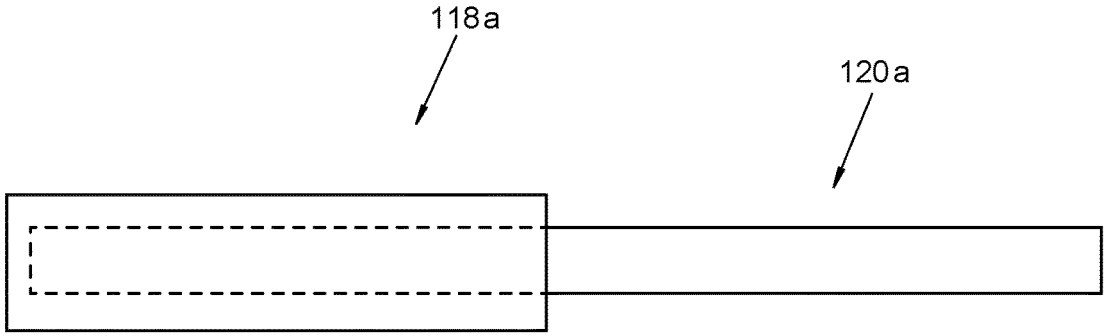
FIG. 5 illustrates a top view of an exemplary ankle cuff and an ankle fastening strap, in accordance with an embodiment of the present invention.

In some embodiments, a pair of ankle cuffs 118*a*, 118*b* attach to the terminal regions 104*a-b* of the bar 102, at a coupling mechanism 110*a*, 110*b*. The ankle cuffs 118*a-b* are annular in shape, and sized to encircle the ankles. Thus by attaching the ankle cuffs 118*a-b* to the ankles, the user becomes attached to the bar 102. In one non-limiting embodiment, the ankle cuffs 118*a-b* are about 7" long if stretched out. The ankle cuffs 118*a-b* comprise an ankle fastening strap 120*a*, 120*b*, such as a hook and loop fastener, or other fastening mechanism that enables the ankle cuffs 118*a-b* to be firmly secured to the ankles (FIG. 5).

The coupling mechanism 110*a*, 110*b* at the ankle cuffs 118*a-b* forms a free swiveling relationship with the terminal regions of the bar 102. In one embodiment, the coupling mechanism 110*a*, 110*b* comprises a first ring 126. And the ankle cuffs 118*a-b* comprise at least one second ring 128*a*, 128*b* that attaches to the first ring 126. However in other embodiments, the coupling mechanism 110*a-b* may include, without limitation, a hook, a screw, a magnet, and an adhesive.

Figure 6A:
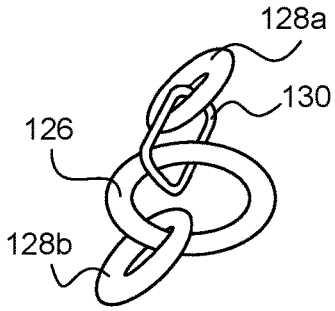
FIGS. 6A and 6B illustrate perspective views of the first and second ring, where
Figure 6B:
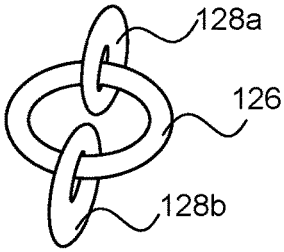

As illustrated in FIGS. 6A and 6B, the first and second rings 126, 128*a-b* couple together to create a swiveling, freely rotatable relationship between the ankle cuffs 118*a-b* and the terminal regions of the bar 102. In one alternative embodiment, at least one link 130 may be used between the rings 126, 128*a-b* to provide greater freedom of movement for the ankles. Thus, the swiveling relationship provides greater freedom of movement to the legs and ankles for manipulating the bar 102 axially and laterally.

In some embodiments, the ankle cuffs 118*a-b* detachably attach to the ankles. In this configuration the legs can move freely to manipulate the bar 102 and the protruding member 116 in a generally axial direction relative to the vagina or anus for sexual stimulation. In this manner, the bar 102 may be pulled, twisted, torques, and pushed by a leg force 150, i.e. manipulation by the cuff-attached ankles and legs, so as to adjust the direction of force, torque, and position of the protruding member 116 in relation to the vagina or anus.

As a result, the leg force 150 applied at the terminal regions 104*a-b* of the bar 102 creates a sensation of sexual stimulation from the protruding member 116. It is also significant to note that indirectly attaching the protruding member 116 to the legs leverages the power provided by the legs for powerful thrusting motions into the vagina or anus by the protruding member 116.

Figure 7:
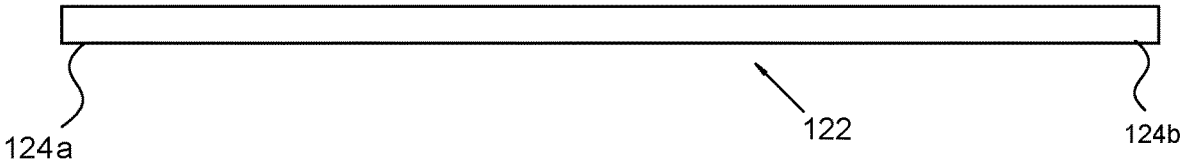
FIG. 7 illustrates a top view of an exemplary strap, in accordance with an embodiment of the present invention.

Turning now to FIG. 7, the device 100 also utilizes a strap 122 that extends between the terminal regions 104*a-b* of the bar 102, attaching to the coupling mechanism 110*a*, 110*b*. The strap 122 is defined by a pair of strap ends 124*a*, 124*b*. In one non-limiting embodiment, the strap 122 is resilient, fabricated from vinyl, and has a length of about 40" and a width of 1". A freely rotating, swiveling relationship forms at the attachment point between the strap ends 124*a-b* and terminal regions 104*a-b* of the bar 102—similar to the ankle cuffs 118*a-b*. The strap 122 is easily grasped by the hands to enable control of the bar 102, and attached protruding member 116.

In operation, the hands grip the strap 122, so as to manipulate the bar 102 and protruding member 116 in axial, rotational, and lateral directions, relative to the vagina or anus. In this manner, the strap 122 may be pulled by a hand force 152, i.e. pulling by the hands, to adjust the direction of force, torque, and position of the protruding member 116 in relation to the vagina or anus. The hand force 152 that is applied to the bar 102 creates a sensation of sexual stimulation from the protruding member 116.

Thus, when used in combination with the ankle cuffs 118*a-b*, both the legs and the hands apply forces on the protruding member 116 at different angles, torques, resistance, or rate of repetition. For example, while the ankle cuffs 118*a-b* are attached to the ankles, the legs can be brought in close to the body to engage the protruding member 116 with the vagina or anus.

The hands can simultaneously tug at either end of the strap 122 to create a lateral, or rotational movement to the protruding member 116 while engaging the vagina or anus. Further, by enabling axial, lateral, and rotational manipulation of the protruding member 116 with the legs and hands, the protruding member 116 can provide eclectic shapes or feels such that the device 100 mimics a human tongue.

Figure 8:
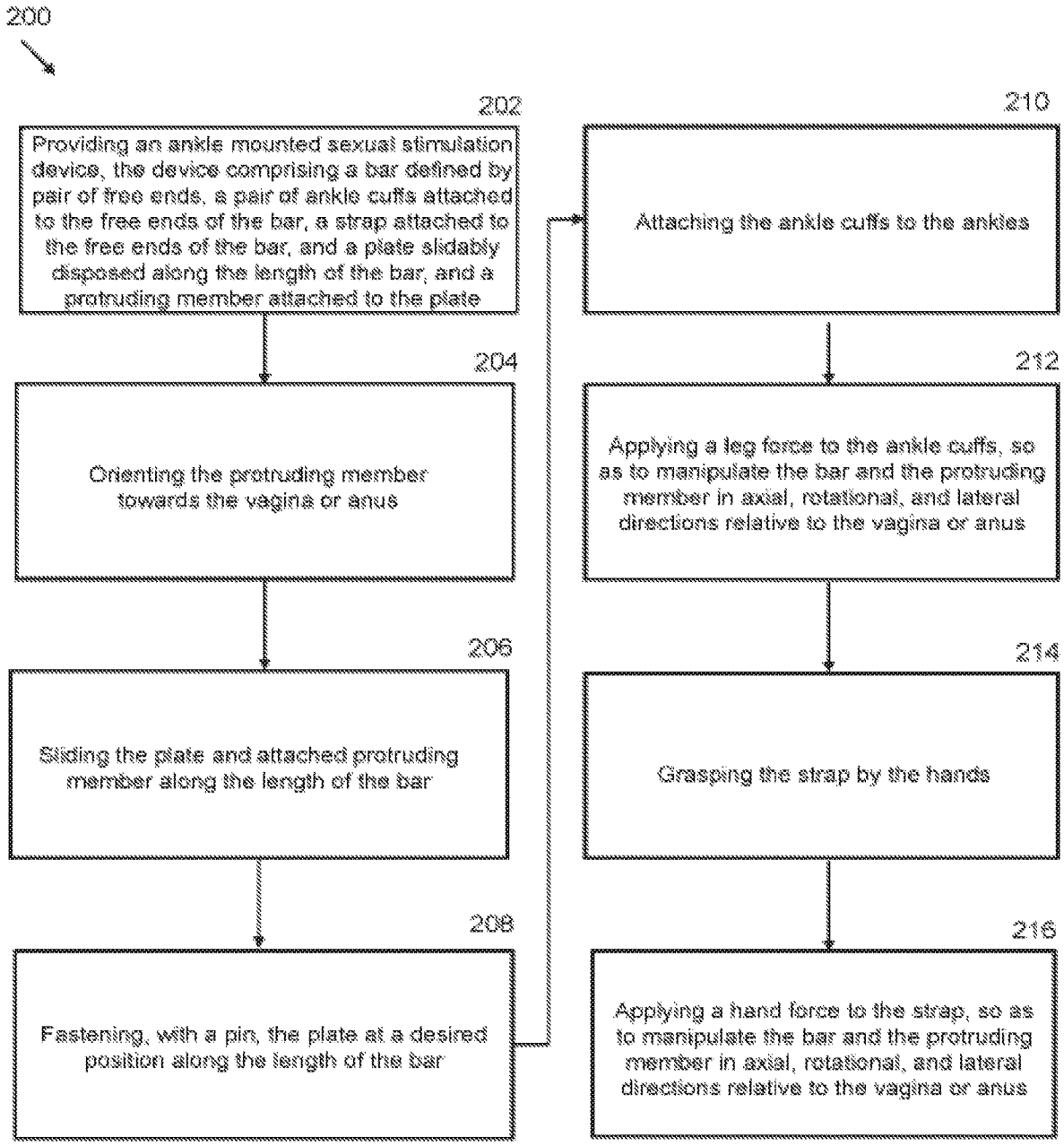
FIG. 8 illustrates a flowchart of an exemplary method of using an ankle-mounted sexual stimulation device, in accordance with an embodiment of the present invention.

FIG. 8 illustrates a flowchart of an exemplary method 200 of using an ankle-mounted sexual stimulation device. The method 200 may include an initial Step 202 of providing an ankle mounted sexual stimulation device, the device comprising a bar defined by pair of terminal regions, a pair of ankle cuffs attached to the terminal regions of the bar, a strap attached to the terminal regions of the bar, and a plate slidably disposed along the length of the bar, and a protruding member attached to the plate.

In some embodiments, the method 200 may further comprise a Step 204 of orienting the protruding member towards the vagina or anus. A Step 206 includes sliding the plate and attached protruding member along the length of the bar. In some embodiments, a Step 208 comprises fastening, with a pin, the plate at a desired position along the length of the bar. A Step 210 includes attaching the ankle cuffs to the ankles.

In some embodiments, a Step 212 may include applying a leg force to the ankle cuffs, so as to manipulate the bar and the protruding member in axial, rotational, and lateral directions relative to the vagina or anus. A Step 214 comprises grasping the strap by the hands. A final Step 216 includes applying a hand force to the strap, so as to manipulate the bar and the protruding member in axial, rotational, and lateral directions relative to the vagina or anus.

Although the process-flow diagrams show a specific order of executing the process steps, the order of executing the steps may be changed relative to the order shown in certain embodiments. Also, two or more blocks shown in succession may be executed concurrently or with partial concurrence in some embodiments. Certain steps may also be omitted from the process-flow diagrams for the sake of brevity. In some embodiments, some or all the process steps shown in the process-flow diagrams can be combined into a single process.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. An ankle mounted sexual stimulation device, the device comprising:

a bar including a pair of terminal regions and a center region, the center region including a plurality of spaced-apart bar apertures;

a coupling mechanisms disposed at each of the terminal regions of the bar;

a plate slidable along a length of the bar, the plate including a plurality of spaced-apart plate apertures;

a protruding member adapted to attach to the plate;

an ankle cuff attached to each of the coupling mechanisms at the terminal regions of the bar, whereby the ankle cuffs and the bar have a swiveling, freely rotational relationship, and a leg force applied to the ankle cuffs manipulates the bar and the protruding member in axial, rotational, and lateral directions; and a strap extending between the terminal regions of the bar, the strap including a pair of strap ends, wherein the strap ends are attached to a respective one of the coupling mechanisms at the terminal regions of the bar, whereby the strap and the bar have a swiveling, freely rotational relationship, and a hand force applied to the strap manipulates the bar and the protruding member in axial, rotational, and lateral directions.

2. The device of claim 1, wherein the bar has a cylindrical shape and is 40 inches long.

3. The device of claim 1, wherein the center region is a tube and has a length of 14 inches.

4. The device of claim 1, wherein the center region of the bar has a larger diameter than a diameter of the terminal regions of the bar.

5. The device of claim 1, wherein the center region has a telescoping relationship with the terminal regions of the bar.

6. The device of claim 1, further comprising a pin, the pin being adapted to pass through the bar apertures and the plate apertures.

7. The device of claim 1, wherein the plate comprises a bracket.

8. The device of claim 7, wherein the bracket is detachably coupled to the bar.

9. The device of claim 1, wherein the protruding member is an artificial erect penis.

10. The device of claim 1, wherein the ankle cuffs are 7" long.

11. The device of claim 1, wherein each of the ankle cuffs comprise an ankle fastening strap.

12. The device of claim 1, wherein each of the coupling mechanisms comprise at least one first ring, and each of the ankle cuffs comprise at least one second ring, and the at least one second ring attaches to the at least one first ring.

13. The device of claim 12, wherein the at least one first ring attaches to the at least one second ring in a swiveling, freely rotational relationship.

14. The device of claim 13, further comprising at least one link disposed between the at least one first ring and the at least one second ring.

15. The device of claim 1, wherein the strap is fabricated from vinyl and has a length of 40 inches.

16. An ankle mounted sexual stimulation device, the device consisting of:

a bar including a pair of terminal regions and a center region, the center region including a plurality of spaced-apart bar apertures;

a first ring disposed at each of the terminal regions of the bar;

a plate slidable along a length of the bar, the plate including a plurality of spaced-apart plate apertures, the plate comprising a bracket, the bracket detachably coupled to the bar;

an artificial erect penis adapted to attach to the plate;

a pin adapted to pass through the bar apertures and the plate apertures;

an ankle cuff attached to each of the first rings at the terminal regions of the bar, each of the ankle cuffs comprising an ankle fastening strap and at least one second ring attached to a respective one of the first rings, whereby the ankle cuffs and the bar have a swiveling, freely rotational relationship, and a leg force applied to the ankle cuffs manipulates the bar and the artificial erect penis in axial, rotational, and lateral directions; and a strap extending between the terminal regions of the bar, the strap including a pair of strap ends, the strap ends attached to a respective one the first rings at the terminal regions of the bar, whereby the strap and the bar have a swiveling, freely rotational relationship, and whereby a hand force applied to the strap manipulates the bar and the artificial erect penis in axial, rotational, and lateral directions.

17. The device of claim 16, wherein the center region has a telescoping relationship with the terminal regions of the bar.

18. The device of claim 16, wherein the center region of the bar has a larger diameter than a diameter of the terminal regions of the bar.

19. The device of claim 16, wherein the bar has a cylindrical shape and is 40 inches long.

20. A method of using an ankle mounted sexual stimulation device, the method comprising:

providing an ankle mounted sexual stimulation device, the device comprising a bar defined by pair of terminal regions, an ankle cuff attached to each of the terminal regions of the bar, each of the terminal region of the bar having a respective strap end of a strap attached therewith, a plate slidably disposed along a length of the bar, and a protruding member attached to the plate;

orienting the protruding member towards a user's vagina or anus;

sliding the plate and attached protruding member along the length of the bar;

fastening, with a pin, the plate at a desired position along the length of the bar;

attaching the ankle cuffs to the user's ankles;

applying a leg force to the ankle cuffs, so as to manipulate the bar and the protruding member in axial, rotational, and lateral directions relative to the vagina or anus;

grasping the strap by the user's hands; and applying a hand force to the strap, so as to manipulate the bar and the protruding member in axial, rotational, and lateral directions relative to the vagina or anus.

* * * * *